US008812324B2

(12) United States Patent
Rodriguez Crespo et al.

(10) Patent No.: US 8,812,324 B2
(45) Date of Patent: Aug. 19, 2014

(54) CODING, MODIFICATION AND SYNTHESIS OF SPEECH SEGMENTS

(75) Inventors: Miguel Angel Rodriguez Crespo, Madrid (ES); Jose Gregorio Escalada Sardina, Madrid (ES); Ana Armenta Lopez de Vicuna, Madrid (ES)

(73) Assignee: Telefonica, S.A., Madrid (ES)

( * ) Notice: Subject to any disclaimer, the term of this patent is extended or adjusted under 35 U.S.C. 154(b) by 524 days.

(21) Appl. No.: 13/254,479

(22) PCT Filed: Dec. 21, 2010

(86) PCT No.: PCT/EP2010/070353

§ 371 (c)(1),
(2), (4) Date: Sep. 2, 2011

(87) PCT Pub. No.: WO2011/076779

PCT Pub. Date: Jun. 30, 2011

(65) Prior Publication Data

US 2011/0320207 A1 Dec. 29, 2011

(30) Foreign Application Priority Data

Dec. 21, 2009 (ES) ..... 200931212

(51) Int. Cl.
*G10L 13/00* (2006.01)

(52) U.S. Cl.
USPC ..... 704/268; 704/220

(58) Field of Classification Search
CPC ..... G10L 25/45
USPC ..... 704/220, 258–269
See application file for complete search history.

(56) References Cited

U.S. PATENT DOCUMENTS

| | | | | |
|---|---|---|---|---|
| 5,452,398 | A | 9/1995 | Yamada et al. | |
| 5,577,160 | A * | 11/1996 | Hosom et al. | 704/209 |
| 6,449,592 | B1 * | 9/2002 | Das | 704/224 |

(Continued)

FOREIGN PATENT DOCUMENTS

| | | |
|---|---|---|
| EP | 1 256 931 | 11/2002 |
| WO | 03/090205 | 10/2003 |
| WO | 2007/007253 | 1/2007 |

OTHER PUBLICATIONS

International Search Report dated Apr. 18, 2011, from corresponding International Application No. PCT/EP2010/070353.

(Continued)

*Primary Examiner* — Abul Azad
(74) *Attorney, Agent, or Firm* — Katten Muchin Rosenman LLP

(57) ABSTRACT

The invention relates to a method for speech signal analysis, modification and synthesis comprising a phase for the location of analysis windows by means of an iterative process for the determination of the phase of the first sinusoidal component and comparison between the phase value of said component and a predetermined value, a phase for the selection of analysis frames corresponding to an allophone and readjustment of the duration and the fundamental frequency according to certain thresholds and a phase for the generation of synthetic speech from synthesis frames taking the information of the closest analysis frame as spectral information of the synthesis frame and taking as many synthesis frames as periods that the synthetic signal has. The method allows a coherent location of the analysis windows within the periods of the signal and the exact generation of the synthesis instants in a manner synchronous with the fundamental period.

11 Claims, 5 Drawing Sheets

$$\tilde{s}(n) = \sum_{j=1}^{J} A_j \cos(\omega_j n + \phi_j)$$

(56) References Cited

U.S. PATENT DOCUMENTS

| | | | | |
|---|---|---|---|---|
| 6,553,344 | B2 * | 4/2003 | Bellegarda et al. | 704/267 |
| 7,315,815 | B1 * | 1/2008 | Gersho et al. | 704/223 |
| 2003/0158734 | A1 * | 8/2003 | Cruickshank | 704/260 |
| 2006/0111908 | A1 | 5/2006 | Sakata | |

OTHER PUBLICATIONS

E. Bryan George, et al. "Speech Analysis/Synthesis and Modification Using an Analysis-by-Synthesis/Overlap-Add Sinusoidal Model" IEEE Transactions on Speech and Audio Processing, vol. 5, No. 5, Sep. 1997.

Yannis Stylianou. "Synchronization of Speech Frames Based on Phase Data with Application to Concatenative Speech Synthesis" 6th European Conference on Speech Communication and Technology. Eurospeech, vol. 5, Jan. 1, 1999, pp. 2343-2346.

Parham Zolfaghari, et al. "Glottal Closure Instant Synchronous Sinusoidal Model for High Quality Speech Analysis/Synthesis" Eurospeech 2003, Sep. 1, 2003, pp. 2441-2444.

Daniel Erro, et al. "Flexible Harmonic/Stochastic Speech Synthesis" Aug. 24, 2007, pp. 194-199, retrieved from http://citeseerx.ist.psu.edu/viewdoc/download?doi=10.1.1.79.3600&rep=rep1&type=pdf on Apr. 7, 2011.

Giacomo Sommavilla, et al. "SMS-FESTIVAL: A New TTS Framework" 5th International Workshop on Models and Analysis of Vocal Emissions for Biomedical Applications, vol. MAVEBA 2007, Dec. 15, 2007, retrieved from http://citeseerx.ist.psu.edu/viewdoc/download?doi=10.1.1.134.1830&rep=rep1&type=pdf on Apr. 7, 2011.

Eric Moulines, et al. "Pitch-Synchronous Waveform Processing Techniques for Text-to-Speech Synthesis Using Diphones" Speech Communication vol. 9, Dec. 1990, pp. 453-467.

T. Dutoit, et al. "MBR-PSOLA: Text-to-Speech Synthesis based on an MBE re-synthesis of the segments database" Speech Communication, vol. 13, 1993, pp. 435-440.

Richard Sproat, et al. "An Approach to Text-to-Speech Synthesis" Speech Coding and Synthesis, Elsevier Science B.V., 1995, pp. 611-633.

Michael W, Macon. "Speech Synthesis Based on Sinusoidal Modeling" PhD Thesis, Georgia Institute of Technology, Oct. 1996.

Miguel Angel Rodriguez Crespo, et al. "On the Use of a Sinusoidal Model for Speech Synthesis in Text-to-Speech" Progress in Speech Synthesis, Springer, 1996, pp. 57-70.

Yannis Stylianou. "Removing Linear Phase Mismatches in Concatenative Speech Synthesis" IEEE Transactions on Speech and Audio Processing, vol. 9, No. 3, Mar. 2001, pp. 232-239.

E. Bryan George. "An Analysis-by-Synthesis Approach to Sinusoidal Modeling Applied to Speech and Music Signal Processing" PhD Thesis, Georgia Institute of Technology, Nov. 1991.

Michael W, Macon, et al. "Speech Concatenation and Synthesis Using an Overlap-Add Sinusoidal Model" ICASSP 96 Conference Proceedings, May 1996.

Robert J. McAulay, et al. "Speech Analysis/Synthesis Based on a Sinusoidal Representation" IEEE Transactions on Acoustics, Speech and Signal Processing, vol. ASSP-34, No. 4, Aug. 1986.

Spanish Search Report dated Jan. 30, 2012, 2011, from corresponding Spanish Application No. 200931212.

* cited by examiner $$\tilde{s}(n) = \sum_{j=1}^{J} A_j \cos(\omega_j n + \phi_j)$$

CODING, MODIFICATION AND SYNTHESIS OF SPEECH SEGMENTS

FIELD OF THE INVENTION

The present invention applies to speech technologies. More specifically, it relates to digital speech signal processing techniques used, among others, inside text-to-speech converters.

BACKGROUND OF THE INVENTION

Many current text-to-speech conversion systems are based on the concatenation of acoustic units taken from prerecorded speech. This approach allowed taking the quality leap necessary for using text-to-speech converters in multiple commercial applications (mainly in the generation of oral information from text in interactive voice response systems which are accessed by voice).

Although the concatenation of acoustic units allows obviating the difficult problem of completely modeling the production of human speech, it has to handle another basic problem: how to concatenate pieces of speech taken from different source files, which may have considerable differences at the concatenation points.

The possible causes of discontinuity and defects in the synthetic speech are of various types:

1. The difference in the characteristics of the spectrum of the signal at the concatenation points: frequencies and bandwidths of the formants, shape and amplitude of the spectral envelope.
2. Loss of phase coherence between the speech frames which are concatenated. They can also be seen as inconsistent relative shifts of the position of the speech frames (windows) on both sides of a concatenation point. The concatenation between incoherent frames causes a disintegration or dispersion of the waveform which is perceives as a significant loss of quality. The resulting speech is unnatural: mixed and confused.
3. Prosodic differences (intonation and duration) between the prerecorded units and the target (desired) prosody for the synthesis of an utterance.

For this reason, text-to-speech converters normally use various processes for speech signal processing which allow, after the concatenation of units, smoothly joining them at the concatenation points, and modifying their prosody so that it is continuous and natural. And all this must be done degrading the original signal as little as possible.

The most traditional text-to-speech conversion systems had a relatively reduced repertoire of units (for example, diphonemes or demisyllables), in which normally there was only one candidate for each of the possible combinations of sounds contemplated. In these systems the need to make modifications in the units is very high.

The most recent text-to-speech conversion systems are based on selecting units from a much wider inventory (corpus-based synthesis). This wide inventory has many alternatives of the different combinations between sounds, which differ in their phonetic context, prosody, position within the word and the utterance. The optimal selection of those units according to a minimum cost criterion (unit and concatenation costs) allows reducing the need to make modifications in the units, and greatly improves the quality and naturalness of the resulting synthetic speech. But it is not possible to completely eliminate the need to handle prerecorded units, because speech corpora are finite and cannot assure a complete coverage to naturally synthesize any utterance, and they will always be concatenation points.

There are different methods for speech signal representation and modification which have been used within text-to-speech converters.

The methods based on the overlap and add of speech signal windows in the time domain (PSOLA, "Pitch Synchronous Overlap and Add", methods) are well accepted and widespread. The most classic of these methods is described in "Pitch-synchronous waveform processing techniques for text-to-speech synthesis using dyphones" (E. Moulines and F. Charpentier, Speech Communication, vol. 9, pp. 453-467, December 1990). Speech signal frames (windows) are obtained in a manner synchronous with the fundamental period (pitch). The analysis windows must be centered in the glottal closure instants (GCIs) or other identifiable points within each period of the signal, which must be carefully found and coherently labeled, to prevent phase mismatches at the concatenation points. The marking of these points is a laborious task which cannot be performed in a completely automatic manner (it requires adjustments), and conditions the good operation of the system. The modification of duration and fundamental frequency (F0) is performed by means of the insertion or deletion of frames, and the lengthening or narrowing thereof (each synthesis frame is a period of the signal, and the shift between two successive frames is the inverse of the fundamental frequency). Since PSOLA methods do not include an explicit speech signal model, it is difficult to perform the task of interpolating the spectral characteristics of the signal at the concatenation points.

The MBROLA (Multi-Band Resynthesis Overlap and Add) method described in "Text-to-Speech Synthesis based on a MBE re-synthesis of the segments database" (T. Dutoit and H. Leich, Speech Communication, vol. 13, pp. 435-440, 1993) deals with the problem of the lack of phase coherence in the concatenations by synthesizing a modified version of the voiced parts of the speech database, forcing them to have a determined F0 and phase (identical in all the cases). But this process affects the naturalness of the speech.

LPC (Linear Predictive Coding) type methods have also been proposed to perform speech synthesis, such as the one described in "An approach to Text-to-Speech synthesis" (R. Sproat and J. Olive, Speech Coding and Synthesis, pp. 611-633, Elsevier, 1995). These methods limit the quality of the speech since they involve an all-pole model. The result greatly depends on whether the original reference speech is adjusted better or worse to the suppositions of the model. It usually gives rise to problems, especially with female or child voices.

Sinusoidal type models have also been proposed, in which the speech signal is represented by means of a sum of sinusoidal components. The parameters of the sinusoidal models allow performing, in quite a direct and independent manner, both the interpolation of parameters and the prosodic modifications. In relation to assuring the phase coherence at the concatenation points, some models have chosen to handle an estimator of the glottal closure instants (a process which does not always provide good results), such as for example in "Speech Synthesis based on Sinusoidal Modeling" (M. W. Macon, PhD Thesis, Georgia Institute of Technology, October 1996). In other cases, the simplification of considering a minimum phase hypothesis (which affects the naturalness of the speech in some cases, making it be perceive as more hollow and damped) has been assumed, as in a work published by some of the inventors of this proposal: "On the Use of a Sinusoidal Model for Speech Synthesis in Text-to- Speech" (M. Á. Rodríguez, P. Sanz, L. Monzón and J. G. Escalada, Progress in Speech Synthesis, pp. 57-70, Springer, 1996).

Sinusoidal models have gradually incorporated different approaches for solving the problem of phase coherence. "Removing Linear Phase Mismatches in Concatenative Speech Synthesis" (Y. Stylianou, IEEE Transactions on Speech and Audio Processing, vol. 9, no. 3, pp. 232-239 March 2001) proposes a method for analyzing speech with windows which shift according to the F0 of the signal, but without the need for them to be centered in the GCIs. Those frames are later synchronized at a common point based on the information of the phase spectrum of the signal, without affecting the quality of the speech. The property of the Fourier Transform is applied in which adding a linear component to the phase spectrum is equivalent to shifting the waveform in the time domain. The first harmonic of the signal is forced to have a resulting phase with a value 0, and the result is that all the speech windows are coherently centered with respect to the waveform, regardless of which specific point of a period of the signal it was originally centered in. The corrected frames can thus be coherently combined in the synthesis.

For the extraction of parameters, analysis-by synthesis processes are performed such as those set forth in "An Analysis-by-Synthesis Approach to Sinusoidal Modelling Applied to Speech and Music Signal Processing" (E. Bryan George, PhD Thesis, Georgia Institute of Technology, November 1991) or in "Speech Analysis/Synthesis and Modification Using an Analysis-by-Synthesis/Overlap-Add Sinusoidal Model" (E. Bryan George, Mark J. T. Smith, IEEE Transactions on Speech and Audio Processing, vol. 5, no. 5, pp. 389-406, September 1997)

In summary, the most usual technical problems faced by text-to-speech conversion systems based on the concatenation of units are derived from the lack of phase coherence at the concatenation points between units.

OBJECT OF THE INVENTION

The object of the invention is to palliate the technical problems mentioned in the previous section. To that end, it proposes a method which enables respecting a coherent location of the analysis windows within the periods of the signal and exactly and suitably generating the synthesis instants in a manner synchronous with the fundamental period. The method of the invention comprises:

a. a phase for the location of analysis windows by means of an iterative process for the determination of the phase of the first sinusoidal component of the signal and comparison between the phase value of said component and a predetermined value until finding a position for which the phase difference represents a time shift less than half a speech sample b. a phase for the selection of analysis frames corresponding to an allophone and readjustment of the duration and the fundamental frequency according to a model, such that if the difference between the original duration or the original fundamental frequency and those which are to be imposed exceeds certain thresholds, the duration and the fundamental frequency are adjusted to generate synthesis frames.

c. a phase for the generation of synthetic speech from synthesis frames taking the information of the closest analysis frame as spectral information of the synthesis frame and taking as many synthesis frames as periods that the synthetic signal has.

Preferably, once the first analysis window is located, the following one is sought by shifting half a period and so on and so forth. A phase correction is optionally performed by adding a linear component to the phase of all the sinusoids of the frame. The modification threshold for the duration is optionally less than 25%, preferably less than 15%. The modification threshold for the fundamental frequency is also optionally less than 15%, preferably less than 10%.

The phase for generation from the synthesis frames is preferably performed by overlap and add with triangular windows. The invention also relates to the use of the method of any of the previous claims in text-to-speech converters, the improvement of the intelligibility of speech recordings and for concatenating speech recording segments differentiated in any characteristics of their spectrum.

BRIEF DESCRIPTION OF THE DRAWINGS

For the purpose of aiding to better understand the features of the invention according to a preferred practical embodiment thereof, a set of drawings is attached to the following description in which the following has been depicted with an illustrative character.

DETAILED DESCRIPTION OF THE INVENTION

The invention is a method for speech signal 1) analysis, and 2) modification and synthesis which has been created for its use in a text-to-speech converter (TSC), for example.

1. Speech Signal Analysis

The sinusoidal model used represents the speech signal by means of the sum of a set of sinusoids characterized by their amplitudes, frequencies and phases. The speech signal analysis consists of finding the number of component sinusoids, and the parameters characterizing them. This analysis is performed in a localized manner in determined time instants. Said time instants and the parameters associated therewith form the analysis frames of the signal.

The analysis process does not form part of the operation of the TSC, but rather it is performed on the voice files to generate a series of analysis frame files which will then be used by the tools which have been developed to create the speakers (synthetic voices) which the TSC loads and handles to synthesize the speech.

The most relevant points characterizing the speech signal analysis are:

a. Extraction of Parameters

The process is supported in the definition of a function of the degree of similarity between the original signal and the signal reconstructed from a set of sinusoids. This function is based on calculating the mean square error.

Figure 1:
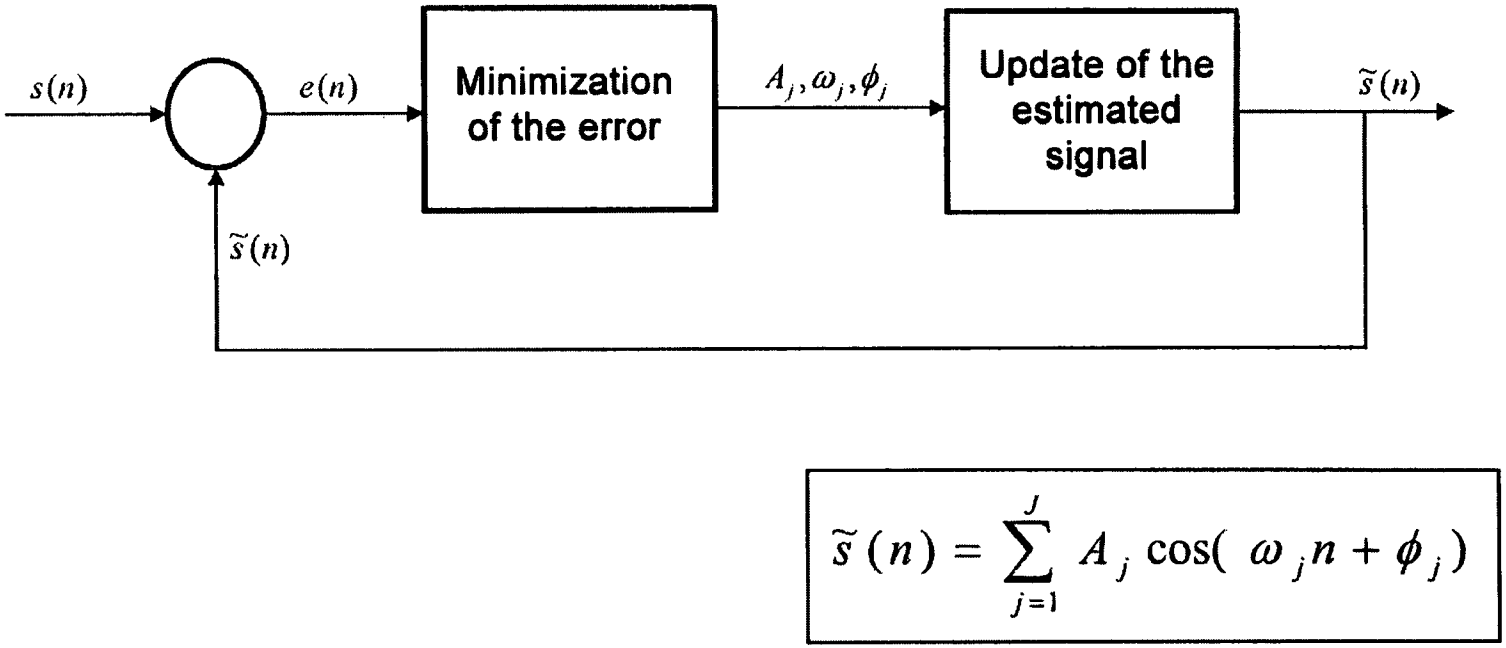
FIG. 1 shows the extraction of sinusoidal parameters.

Taking into account this error function, the sinusoidal parameters are obtained iteratively. Starting from the original signal, the triad of values (amplitude, frequency and phase) representing the sinusoid which reduces the error to the greatest extent is sought. That sinusoid is used to update the signal representing the error between the original and estimated signal and, again, the calculation is repeated to find the new triad of values minimizing the residual error. The process continues in this way until the total set of parameters of the frame is determined (either because a determined signal-to-noise ratio value is reached, because a maximum number of sinusoidal components is reached, or because it is not possible to add more components). FIG. 1 shows this iterative method for obtaining the sinusoidal parameters.

This method for analysis makes the calculation of a sinusoidal component be performed by taking into account the accumulated effect of all the previously calculated sinusoidal components (which did not occur with other methods for analysis based on the maxima of the FFT, Fast Fourier Transform, amplitude spectrum). It also provides an objective method which assures that there is a progressive approach to the original signal.

An important difference between the previously known processes and the one proposed by the invention is the location of the analysis windows. In the mentioned references, although the analysis windows have a width dependent on the fundamental period, they shift at a fixed rate (a value of 10 ms of shift is quite common). In this case, taking advantage of the fact that the complete voice files are available (the speech does not have to be analyzed as it arrives), the analysis windows also have a width dependent on the fundamental period, but their position is determined iteratively, as described below.

b. Iterative Analysis Synchronous with the Fundamental Frequency

The location of the windows affects the calculation of the estimated parameters in each analysis frame. The windows (which can be of a different type) are designed to emphasize the properties of the speech signal in its center, and are attenuated at its ends. In this invention, the coherence in the location of the windows has been improved, such that these windows are located in sites that are as homogeneous as possible along the speech signal. A new iterative mechanism for the location of the analysis windows has been incorporated.

This new mechanism consists of finding out, for the voiced frames, which is the phase of the first sinusoidal component of the signal (the one closest to the first harmonic), and checking the difference between that value and a phase value defined as target (a value of 0 can be considered, without loss of generality). If that phase difference represents a time shift equal to or greater than half a speech sample, the values of the analysis of that frame are discarded, and an analysis is again performed by shifting the window the necessary number of samples. The process is repeated until finding the suitable value of the position of the window, at which time the analyzed sinusoidal parameters are considered to be good. Once the position is found, the following analysis window is sought by shifting half a period. In the event that an unvoiced frame is found, the analysis will be considered valid, and it will be shifted 5 ms forwards to seek the position of the following analysis frame.

Figure 2:
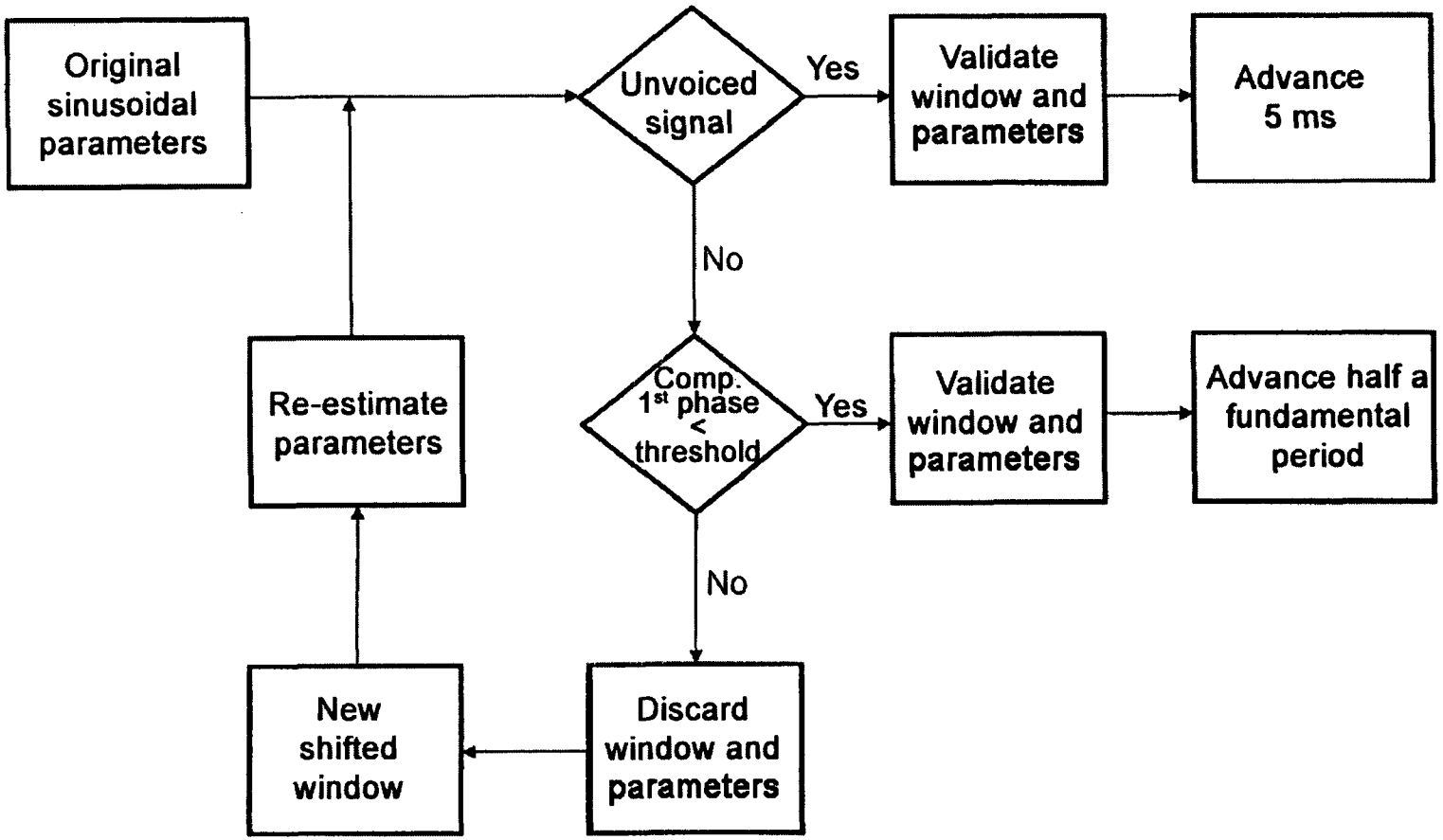
FIG. 2 shows the location of the analysis windows.

This iterative process for the location of the analysis windows is illustrated in FIG. 2.

c. Residual Excitation Phase

After locating the position of the window, a phase correction (adding a linear phase component to all the sinusoids of the frame) is performed so that the corresponding value associated with the first sinusoidal component is the target value for the voice file. But, furthermore, the residual value represented by the difference between both values is conserved and saved as one of the parameters of the frame. That value will usually be very small as a result of the iterative analysis synchronous with the fundamental frequency, but it can have relative importance in the cases in which F0 is high (the phase corrections upon adding a linear component are proportional to the frequency). Furthermore, it is taken into account because it allows reconstructing the synthetic signal aligned with the original signal (in the cases in which the F0 and duration values of the analysis frames are not modified).

d. Quantification

The parameters of the sinusoidal analysis (frequencies, amplitudes and phases of the component sinusoids) are obtained as floating-point numbers. A quantification is performed to reduce the memory occupation needs for storing the results of the analysis.

The components representing the harmonic part of the signal (and forming the spectral envelope) are quantified together with the additional (harmonic or noise) components. All the components are ordered in increasing frequencies before the quantification.

The frequency difference between consecutive components is quantified. If this difference exceeds the threshold marked by the maximum quantifiable value, an additional fictitious component (marked by a special frequency difference value, amplitude 0.0, and phase 0.0) is added.

The phases of the components are obtained in $2\pi$ modulus (values comprised between $-\pi$ and $\pi$). Although this makes the interpolation of phase values at points other than those known difficult, it allows dimensioning the margin of values and facilitates the quantification.

2. Speech Signal Modification and Synthesis

Speech signal modification and synthesis are the processes performed within the TSC to generate a synthetic speech signal:

- Which pronounces the sequence of sounds corresponding to the input text.
- Which does so from the analysis frames making up the inventory of units of the speaker.
- Which responds to prosody (duration and fundamental frequency) generated by the prosodic models of the TSC.

For this it is necessary to select a sequence of frames of the original speech (analysis frames), suitably modifying them to give rise to a sequence of modified frames (synthesis frames), and performing the speech synthesis with the new sequence of frames.

The selection of the units is performed by means of corpus-based selection techniques.

The following points must be taken into account:

- Natural speech is not purely harmonic, as is demonstrated when obtaining the parameters of the analysis frames. Therefore, generating a purely harmonic synthetic speech is a simplification which can affect the perceived quality. The synthesis with sinusoidal components which are not purely harmonic can aid in improving said quality.
- The synthesis synchronous with the fundamental period (the existence of a biunivocal correspondence between synthesis frames and periods of the synthetic signal) favors the coherence of the signal, and reduces the dispersion of the waveform (for example, when lengthenings are performed and/or F0 increases with respect to the duration and F0 values).
- The more the characteristics of the original signal are respected, the better the quality of the generated speech (closer to the original signal). The attempt must be made to not modify the analysis frames very much, whenever it is possible.

The processes for signal modification and synthesis used in the invention are set forth below.

a. Recovery of Parameters

First of all, the sinusoidal parameters are recovered from the quantified values saved in the analysis frames. To that end, the steps that took place in the quantification are reversed.

The new way to organize the sinusoidal parameters (frequencies, amplitudes and phases of the component sinusoids) after the recovery is:

Firstly, the parameters corresponding to the sinusoids modeling the spectral envelope, in increasing frequency order (between 0 and $\pi$), are found. The sinusoids modeling the spectral envelope represent the voiced component of the signal and will be used as base interpolation points for calculating amplitude and/or phase values in other voiced frequencies.

Then, the parameters corresponding to the sinusoids which do not model the spectral envelope and which are considered as "noise", "non-harmonic" or "unvoiced" sinusoids, will be found. These "noise" components also appear in increasing frequency order (but always after the last component of the envelope, which must obligatorily be at the frequency $\pi$).

b. Adjustment of Duration

The general process is that, once the analysis frames corresponding to an allophone have been gathered, the original accumulated duration of those frames is calculated. This duration is compared with the value calculated by the speaker duration (synthetic duration) model, and a factor relating both durations is calculated. That factor is used to modify the original durations of each frame, such that the new durations (shift between synthesis frames) are proportional to the original durations.

A threshold for performing the adjustment of durations has furthermore been defined. If the difference between the original duration and the one to be imposed is within a margin (a value of 15% to 25% of the synthetic duration can be considered, although this value can be adjusted), the original duration is respected, without performing any type of adjustment. In the event that it is necessary to adjust the duration, the adjustment is performed so that the imposed duration is the end of the defined margin closest to the original value.

c. Assignment of the F0

F0 values generated by the intonation (synthetic F0) model are available. Those values are assigned to the initial, middle and final instants of the allophone. Once the component frames of the allophone and their duration are known, an interpolation of the available synthetic F0 values in those three points is performed, in order to obtain the synthetic F0 values corresponding to each of the frames. This interpolation is performed taking into account the duration values assigned to each of the frames.

Thus, for each of the analysis frames there is an original F0 value and another synthetic F0 value (the one to be imposed in principle).

An alternative is to perform an adjustment similar to the adjustment of durations: defining a margin (around 10% or 15% of the synthetic F0 value) within which no modifications of the original F0 value would be made, and adjusting the modifications to the ends of that same margin (to the end closest to the original value).

Since the change of the F0 of the frames considerably affects the quality of the synthetic speech, another alternative is to respect the original F0 values of the analysis frames, without making any type of modification (with the exception of those derived from the spectral interpolation, which will be discussed below). The latter option allows better preserving the timbre and sharpness of the original speech.

d. Spectral Interpolation

The spectral interpolation performed is based on the common principles of tasks of this type, such as those set forth in "Speech Concatenation and Synthesis Using an Overlap-Add Sinusoidal Model" (Michael W. Macon and Mark A. Clements, ICASSP 96 Conference Proceedings, May 1996)

Spectral interpolation is performed at the points at which there is a "concatenation" of frames which were not originally consecutive in the speech corpus. These points correspond to the central part of an allophone which, in principle, has more stable acoustic characteristics. The selection of units performed for corpus-based synthesis also takes into account the context in which the allophones are located, in order for the "concatenated" frames to be acoustically similar (minimizing the differences due to the coarticulation because of being located in different contexts).

Despite everything, the interpolation is necessary to smooth the transitions due to the "concatenation" between frames.

Since unvoiced sounds can include significant variations in the spectrum, even between originally contiguous successive frames, the decision has been made to not interpolate at the concatenation points corresponding to theoretically unvoiced sounds, to prevent introducing a smoothing effect which is unnatural in many cases, and which causes the loss of sharpness and detail.

Spectral interpolation consists of identifying the point at which the concatenation occurs, determining which is the last frame of the left part of the allophone (LLP), and the first frame of the right part of the allophone (FRP). Once these frames are found, an interpolation area towards both sides of the concatenation point which includes 25 milliseconds on each side (unless the limits of the allophone are exceeded due to reaching the boundary with the previous or following allophone before) is defined. When the speech frames belonging to each of the interpolation areas (the left and the right) have already been defined, the interpolation is performed. The interpolation consists of considering that an interpolated frame is constructed by means of the combination of the pre-existing frame ("own" frame), weighted by a factor ("own" weight), and the frame which is on the other side of the concatenation boundary ("associated" frame), also weighted by another factor ("associated" weight). Both weights must add up to 1.0, and are made to evolve in a manner proportional to the duration of the frames. Specifying what has been stated:

In the left area, the last frame of the left part (LLP), with a weight of 0.5, is combined with the first frame of the right part (FRP), also with a weight of 0.5. As there is a shift towards the left and a movement away from the concatenation point, the "own" weight gradually increases (that of each of the frames), and the "associated" weight gradually decreases (that of the FRP frame).

In the right area, the first frame of the right part (FRP), with a weight of 0.5, is combined with the last frame of the left part (LLP), also with a weight of 0.5. As there is a shift towards the right and a movement away from the concatenation point, the "own" weight gradually increases (that of each of the frames), and the "associated" weight gradually decreases (that of the LLP frame).

The spectral interpolation affects various parameters of the frames:

The value representing the amplitude envelope. In "own" frames this value is substituted with the linear combination of the original value of the "own" frame and the original value of the "associated" frame. With this, the intention is to prevent amplitude discontinuities The fundamental frequency value (F0). Likewise, in "own" frames this value is substituted with the linear combination of the original value of the "own" frame and the original value of the "associated" frame. The interpolation of F0 causes, although they are initially respected, the original F0 values of the frames to be modified to perform a smooth evolution at the concatenation points (whereby F0 discontinuities are prevented).

The actual spectral information, reflected in the sinusoidal components of each frame. Each frame is considered to be formed by two sets of sinusoidal components: that of the "own" frame and that of the "associated" frame. Each of the sets of parameters is affected by the corresponding weight. With this, the intention is to prevent spectral discontinuities (the abrupt changes of timbre in the middle of a sound).

e. Differences with Respect to the Harmonics

Before continuing with the synthesis process, data which allow estimating which would be the set of frequencies corresponding to a given fundamental frequency are calculated for each frame.

As has already been stated, natural speech is not purely harmonic. In the analysis, frequencies, together with their corresponding amplitudes and phases, have been obtained which present the envelope of the signal. There is also an estimation of the fundamental frequency (F0). The frequencies of the component sinusoids representing the envelope of the signal are not exact multiples of F0.

The sinusoidal components representing the envelope of the signal have been obtained such that there is one (and only one) in the area of frequencies corresponding to each of the theoretical harmonics (exact multiples of F0). The data which are calculated are the factors between the real frequency of each of the sinusoidal components representing the envelope, and the corresponding harmonic frequency thereof. Since the existence of a sinusoidal component at the frequency 0 and at the frequency $\pi$ is always forced in the analysis (although they do not actually exist, in which case the amplitude thereof would be 0), there is a set of points characterized by their frequency (that of the original theoretical harmonics plus the frequencies 0 and $\pi$) and the factor between real frequency and harmonic frequency (at 0 and $\pi$ this factor will be 1.0). When the "corrected" or "equivalent" frequencies of the sinusoidal components which corresponds to a determined F0 value, different from the original F0 value of the frame, are to be known, the following will be done:

A multiple of the new fundamental frequency (a new harmonic) will be taken.

The data of original harmonic frequency and previous and following factor in relation to the new harmonic will be located.

An intermediate factor will be obtained by means of the linear interpolation of the previous and following factors.

That factor will be applied to the new harmonic to obtain its corresponding "corrected" frequency.

New sets of frequencies for a given F0 which are not purely harmonic can thus be obtained. The process also assures that if the original fundamental frequency is used, the frequencies of the original sinusoidal components would be obtained.

f. Location of the Synthesis Frames

One of the most important aspects of the invention is the determination of the synthesis frames.

The first point in the determination of the synthesis frames is the location thereof, and the calculation of some of the parameters related to that location: the F0 value at that instant, and the residual value of the phase of the first sinusoidal component (shift with respect to the center of the frame). It should be remembered that in the analysis, the parameters of each frame were obtained such that the phase of the first sinusoidal component was a determined one. The parameters represent the waveform of a period of the speech, centered in a suitable point (around the area with the highest energy of a period) and homogeneous for all the frames (whether or not they are from the same voice file).

Since the objective sought is to perform a synthesis synchronous with the fundamental period, this requires having as many frames as periods of the synthetic signal.

If the speech is to be synthesized between two successive analysis frames, and neither the duration between the frames nor the F0 of each of them is modified, the synthesis frames which would have to be used would coincide exactly with the analysis frames.

But in a general case, in which there may be modifications of both F0 and the duration, the number of synthesis frames necessary for synthesizing the speech between two analysis frames will change.

Figure 3:
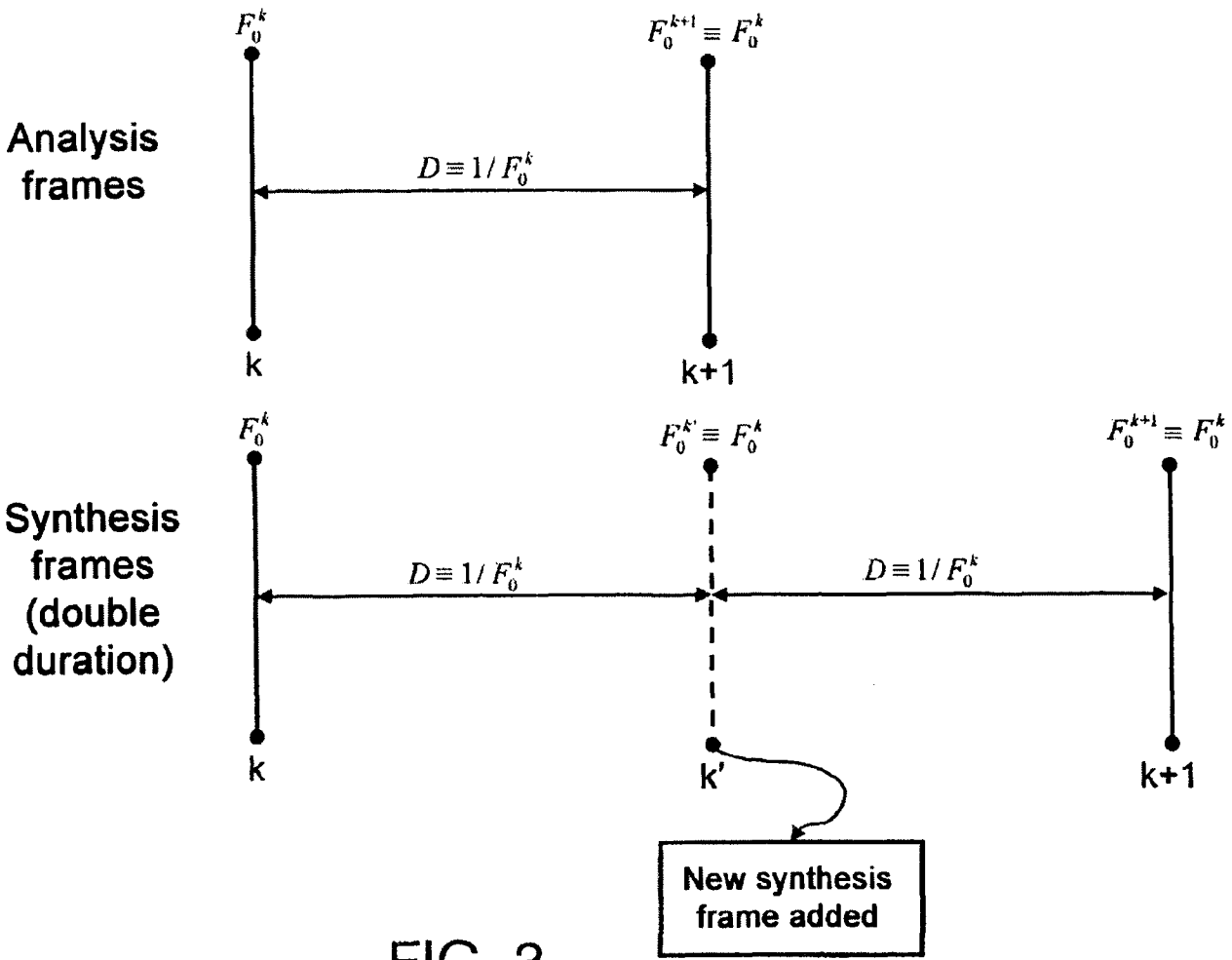
FIG. 3 shows the change to double duration.

Suppose a simple case in which there are two analysis frames which have exactly the same F0 value and which were originally separated by a number of samples D (equal to the fundamental period of both frames). If in the synthesis, the duration were increased to the double (separation 2D), in order to synthesize the signal between the two original analysis frames in a manner synchronous with the fundamental period, three synthesis frames located in durations 0, D and 2D would have to be used (taking as a duration reference the first of the analysis frames, and locating the second of the analysis frames in 2D). FIG. 3 depicts this simple case.

If there are changes of duration and/or F0, the second of the analysis frames can be located at a point in which it is necessary to add a time shift (a phase deviation of its first sinusoidal component) to correctly represent the corresponding waveform at that point (which will not necessarily be a point at which a synthesis frame has to be located). That time shift would have to registered and taken into account for the subsequent synthesis interval between that frame and the one coming next. This value is called phase variation due to the changes of F0 and/or duration, and is represented by $\delta$.

The process which is followed to locate the synthesis frames and obtain the parameters which must characterized them (in addition to the set of amplitudes, frequencies and phases of each one) are set forth.

The process is applied between two consecutive analysis frames, identified by the indices k and k+1. Certain values of the frame k (the frame of the left), which will be updated as the analysis frames are run through, are considered to be known. These values refer to the phase of the first sinusoidal component of the frame (the one closest to the first harmonic of the speech signal), and are:

$$\theta_k=\phi_k+\delta_k$$

where:

$\theta_k$ phase of the first component of the frame k.

$\phi_k$ residual phase of the first component of the frame k, obtained during the analysis of the speech signal.

$\delta_k$ phase variation of the first component of the frame k, due to the changes of F0 and/or duration with respect to the original values.

Firstly, certain values are obtained under the hypothesis that there have been no changes of F0 or duration, which will be taken into account in the subsequent calculations.

These values are:

$$\Delta\theta = \frac{(F_k + F_{k+1}) \cdot D \cdot \pi}{F_s}$$

$$\rho_{k+1} = \varphi_{k+1} + 2M\pi - \varphi_k - \Delta\theta$$

Where:

$\Delta\theta$ phase increment due to the time evolution from one frame to another.

$\rho_{k+1}$ correction of the phase increment for the frame k+1.

Which are Obtained from Known Data:

$F_k$ frequency of the first component of the frame k.

$F_{k+1}$ frequency of the first component of the frame k+1.

D distance (duration) between the frames k and k+1, expressed in number of samples.

$F_s$ sampling frequency of the signal.

M integer which is used to increment $\phi_{k+1}$ (residual phase of the first component of the frame k+1) in a multiple of $2\pi$ to assure a phase evolution which is as linear as possible.

The previous calculation of $\Delta\theta$ and $\rho_{k+1}$ corresponds to the case in which the frames between which synthesis will be performed were contiguous in the original speech corpus ("concatenation" has not occurred).

If "concatenation" has occurred (the frames were not contiguous in the original speech corpus), $\Delta\theta$ and $\rho_{k+1}$ values equal to zero are taken, given that the frames were not consecutive and, therefore, a relationship between both cannot be established.

With these data, other new data are obtained, now taking into account the changes of F0 and duration. The modified values with respect to the original values are represented with an apostrophe:

$$\Delta\theta' = \frac{(F'_k + F'_{k+1}) \cdot D' \cdot \pi}{F_s}$$

$$\delta_{k+1} = \delta_k + \Delta\theta' - \Delta\theta$$

The value $\delta_{k+1}$ is the resulting phase variation for the frame k+1 due to the changes of F0 and/or duration, which will be taken as a reference for the calculations between that frame and the one after it, in the following iteration (the frame k+1 will become the frame k, and the frame k+2 will become the frame k+1).

With the data obtained up until now, the following can be calculated:

$$\theta_{k+1} = \theta_k + \Delta\theta' + \rho_{k+1}$$

where $\theta_{k+1}$ is the resulting phase of the first component of the frame k.

The formulation of a polynomial function which continuously calculates the evolution of the phase of the first component from the frame k to the frame k+1 (from one frame to the following one) according to the index of the samples between both frames has been achieved. This function is a polynomial of order 3 (cubic polynomial) which has to meet certain contour conditions:

- The value $\theta_k$ of the phase of the first component of the frame of the left (the one corresponding to the time instant or index of samples 0).
- The value $\theta_{k+1}$ of the phase of the first component of the frame of the right (the one corresponding to the time instant or index of samples D').
- The value $F'_k$ of the frequency of the first component of the frame of the left.
- The value $F'_{k+1}$ of the frequency of the first component of the frame of the right.

Taking into account that the derivative of the phase is the frequency, the contour conditions can be imposed and the values of the four coefficients of the cubic phase interpolator polynomial can be obtained.

Once all the data necessary for determining the cubic polynomial representing the evolution of the phase deviation are obtained, an attempt is made to locate the points at which the synthesis windows will be placed so that they are synchronous with the fundamental period.

This process consists of finding the points (the shift indices with respect to the frame of the left) at which the value of the polynomial is as close as possible to 0 or to a whole multiple of 2 $\pi$. As a result of the entire process for the location of synthesis frames, the following will be obtained:

- The number of synthesis frames existing between two analysis frames. It may even occur that there is no synthesis frame between two analysis frames (for example if F0 decreases greatly, and/or the duration decrease greatly).
- The whole indices corresponding to the points of the polynomial at which the value is as close as possible to 0 or a whole multiple of $2\pi$. Those indices identify the sites in which the synthesis windows will be placed.
- The phase value given by the polynomial at those points. It will be the residual phase corresponding to the synthesis frame which will have to be placed at those points.
- The F0 value at those points, calculated as the linear interpolation of the values of the analysis frames of the left and of the right.

Figure 4:
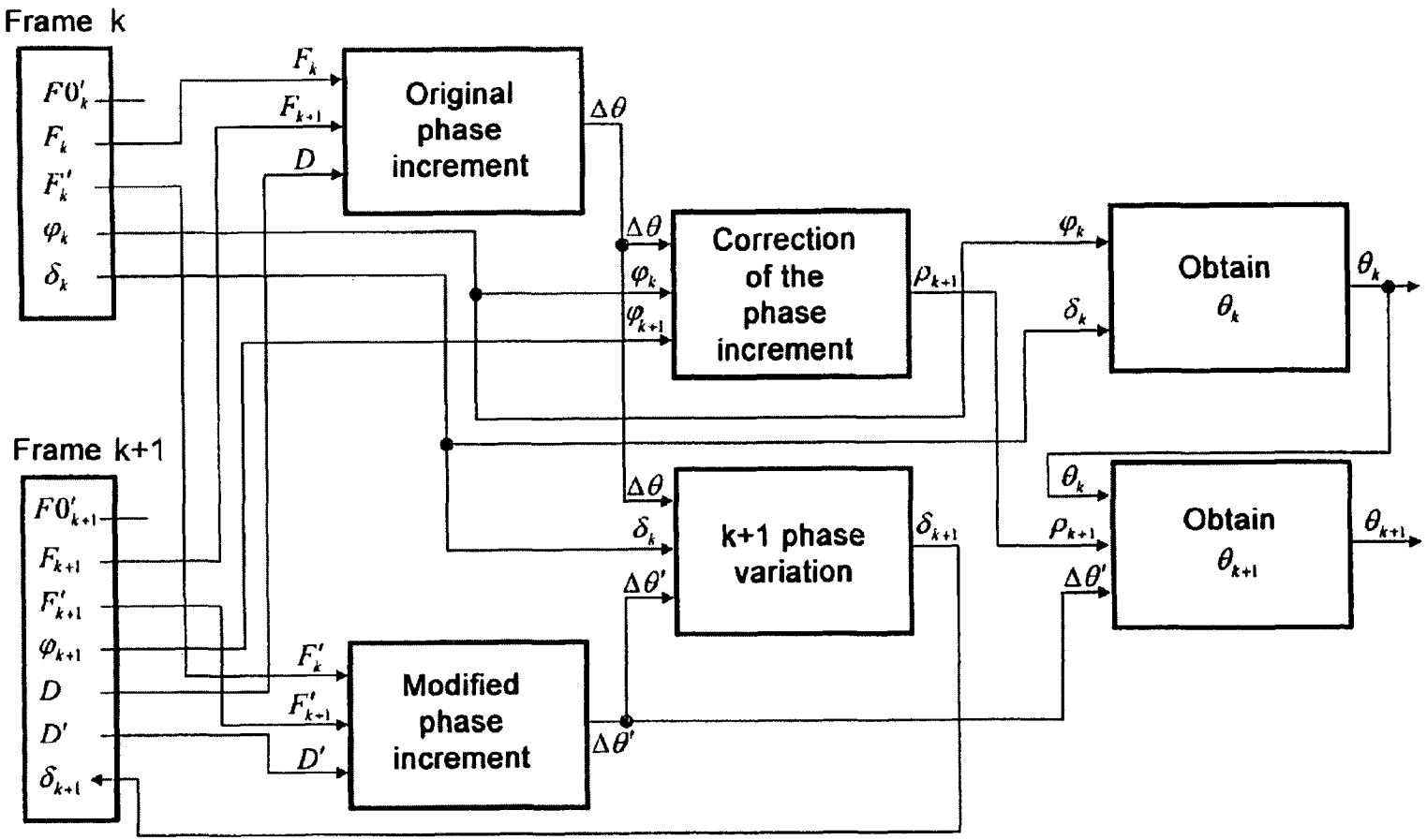
FIG. 4 shows the location of the synthesis windows (1).
Figure 5:
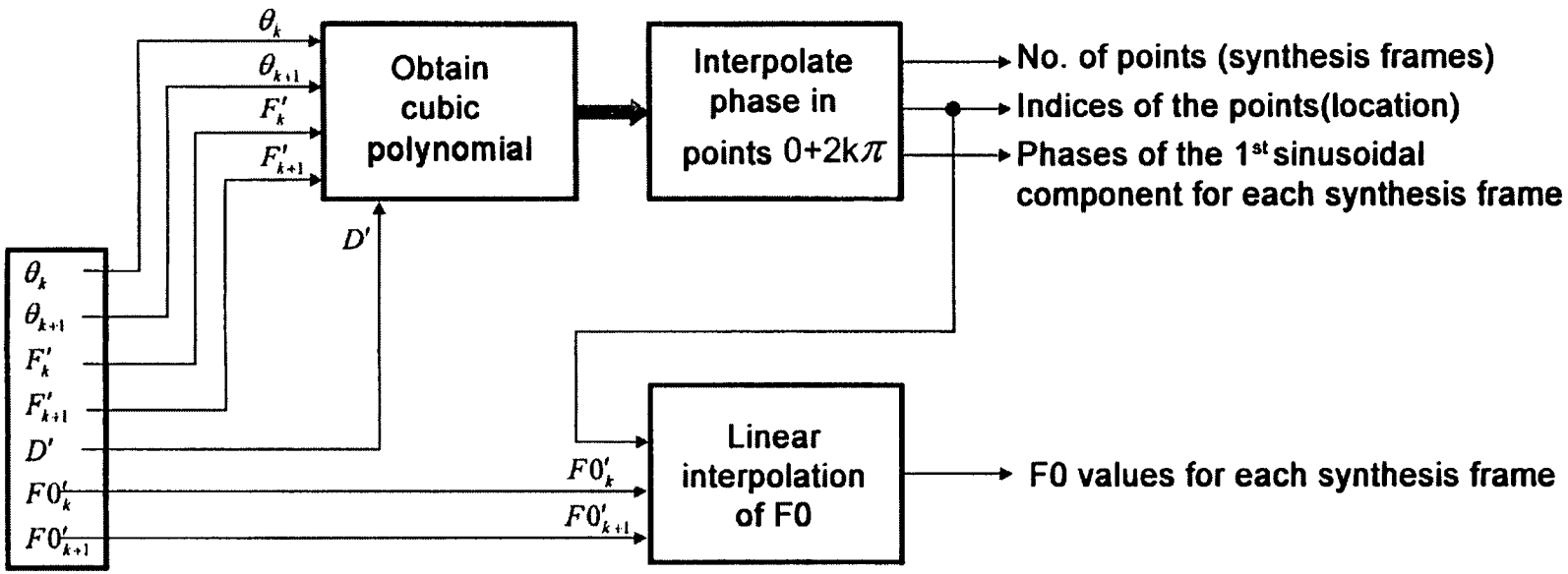
FIG. 5 shows the location of the synthesis windows (2).

FIGS. 4 and 5 schematize the process for obtaining the location of the synthesis frames and their associated parameters.

g. Parameters for the Synthesis

Once a set of synthesis frames (those located between two analysis frames) is obtained, an attempt is made to obtain the parameters which will allow generating the synthetic speech signal. These parameters are the frequency, amplitude and phase values of the sinusoidal components. These triads of parameters are usually referred to as "peaks", because in the most classic formulations of sinusoidal models, such as "Speech Analysis/Synthesis Based on a Sinusoidal Representation" (Robert J. McAulay and Thomas F. Quatieri, IEEE Transactions on Acoustics, Speech, and Signal Processing, vol. ASSP-34, no. 4, August 1986), the parameters of the analysis were obtained upon locating the local maxima (or "peaks") of the amplitude spectrum.

Before obtaining the "peaks", it is necessary to completely characterize the synthesis frames. The F0 and the residual phase of the first sinusoidal component, in addition to the distance (number of samples) with respect to the previous frame, of these frames are already known. What has not been completely specified is the spectral information which will characterize those frames.

Strictly speaking, if the position of the synthesis frames does not coincide with that of the analysis frames used to obtain them, some type of interpolation or mixture of the spectrum of the analysis frames would have to be performed to characterize the spectrum of the synthesis frames located between the analysis frames. Tests of this type (with a strategy similar to that used in the spectral interpolation at the concatenation points) have been conducted with quite a good result. However, considering the impact of this interpolation on the calculation burden and taking into account that in corpus-based synthesis there is a reliance on not modifying the prosody values of the original speech too much, the decision has been made to use a much simpler strategy: the spectral information of a synthesis frame is the same as that of the closest analysis frame.

To obtain the synthesis "peaks" corresponding to a frame, the type of frame and the values of the F0 values which have to be used in the synthesis and the F0 values which the frame originally had are first checked.

If the frame is completely unvoiced (the sound probability is 0), or the original and synthetic F0 values coincide, the synthesis "peaks" coincide with the analysis "peaks" (both those which model the envelope and the additional ones). It is only necessary to introduce the residual phase of the first sinusoidal component (obtained by means of the cubic polynomial), to suitably align the frame.

If the frame is not completely unvoiced and the synthetic F0 does not coincide with the original one, then a sampling of the spectrum must be performed to obtain the peaks. Firstly, the sound probability of the frame is used to calculate the cuttoff frequency separating the voiced part from the unvoiced part of the spectrum. Within the voiced part, multiples of the synthesis F0 (harmonics) are gradually taken. For each harmonic, the corrected frequency is calculated as has been stated in a previous section (Differences with respect to the harmonics). Then, the amplitude and phase values corresponding to the corrected frequency are obtained, using the "peaks" modeling the envelope of the original signal. The interpolation is performed on the real and imaginary part of the "peaks" of the original envelope which have a frequency closer (upper and lower) to the corrected frequency. Once the cutoff frequency is reached, the original "peaks" located above it (both the "peaks" modeling the original envelope and the non-harmonics) are added.

In this second case (a frame which is not completely unvoiced, and with a synthetic F0 which does not coincide with the original one) it is necessary to introduce two corrections:

An amplitude correction. The fact of changing the frequency changes the number of "peaks" located within the voiced part. This makes the synthesized signal have an amplitude different from that of the original signal, which translates into a change in the sensation of the volume perceived (the signal is heard in a "weaker" manner, if F0 increases, or in a "stronger" manner", if F0 decreases). A factor based on the ratio between the synthetic and original F0 values is calculated for the purpose of maintaining the energy of the voiced part of the signal. This factor is only applied to the amplitude of the "peaks" of the voiced part.

A phase correction. When F0 is changed, the frequency of the first sinusoidal component is different from the value that it originally had and, consequently, the phase of that component will also be different. In the analysis, a residual phase was obtained which was eliminated from the original frame so that the phase of the first component had a specific value (the one corresponding to a frame suitably centered in the waveform of the period). The phase correction which has to be introduced takes into account, firstly, the recovery of the specific phase value for the first synthetic sinusoidal component. It also takes into account the residual phase which has to be added to the frame (coming from the calculations performed with the cubic polynomial). The phase correction takes into account both effects and is applied to all the peaks of the signal (it should be recalled that a linear component of phase is equivalent to a shift of the waveform).

In the cases in which a synthesis frame is affected by the spectral interpolation due to "concatenation", it must be taken into account that its spectrum is made up of two parts: the part due to its "own" spectrum and the part due to the "associated" spectrum of the frame with which it is combined. The way to treat this case when obtaining parameters for the synthesis consists of obtaining the "peaks" both for the "own" spectrum and for the "associated" spectrum (each of them affected by the amplitude factor corresponding to the "own" and "associated" weight that they have in the combination), and considering that the frame is made up of both sets of peaks. It should be emphasized that the same synthetic F0 and residual phase value is used when obtaining the "peaks" in both spectra.

h. Overlap and Add Synthesis

The synthesis is performed by combining, in the time domain, the sinusoids of two successive synthesis frames. The samples generated are those which are located at the points existing between them.

At each point, the sample generated by the frame of the left is multiplied by a weight which gradually decreases linearly until reaching a value of zero at the point corresponding to the frame of the right. In contrast, the sample generated by the frame of the right is multiplied by a weight complementary to that of the frame of the left (1 minus the weight corresponding to the frame of the left). This is what is known as overlap and add with triangular windows.

The invention claimed is:

1. Method for speech signal analysis, modification and synthesis comprising:

a. a phase for the location of analysis windows by means of an iterative process for the determination of the phase of the first sinusoidal component of the signal and comparison between the phase value of said component and a predetermined value until finding a position for which the phase difference represents a time shift less than half a speech sample b. a phase for the selection of analysis frames corresponding to an allophone and readjustment of the duration and the fundamental frequency according to a model, such that if the difference between the original duration or the original fundamental frequency and those which are to be imposed exceeds certain thresholds, the duration and the fundamental frequency are adjusted to generate synthesis frames, c. a phase for the generation of synthetic speech from synthesis frames, taking the information of the closest analysis frame as spectral information of the synthesis frame and taking as many synthesis frames as periods that the synthetic signal has.

2. Method according to claim 1, wherein once the first analysis window is located, the following one is sought by shifting half a period and so on and so forth.

3. Method according to claim 1, wherein a phase correction is performed by adding a linear component to the phase of all the sinusoids of the frame.

4. Method according to claim 1, wherein the modification threshold for the duration is less than 25%.

5. Method according to claim 4, wherein the modification threshold for the duration is less than 15%.

6. Method according to claim 1, wherein the modification threshold for the fundamental frequency is less than 15%.

7. Method according to claim 6, wherein the modification threshold for the fundamental frequency is less than 10%.

8. Method according to claim 1, wherein the phase for generation from the synthesis frames is performed by overlap and add with triangular windows.

9. Use of the method of claim 1 in text-to-speech converters.

10. Use of the method of claim 1 for improving the intelligibility of speech recordings.

11. Use of the method of claim 1 for concatenating voice recording segments differentiated in any characteristics of their spectrum.

* * * * *